United States Patent [19]

Apodaca

[11] 4,012,068

[45] Mar. 15, 1977

[54] LITTER TONGS

[76] Inventor: Edward L. Apodaca, 11896 Lavinia Lane, North Glenn, Colo. 80233

[22] Filed: Aug. 12, 1975

[21] Appl. No.: 604,051

[52] U.S. Cl. ..... 294/33; 294/16; 294/99 R; 81/43; 128/354

[51] Int. Cl.[2] ..... B25B 9/02

[58] Field of Search ..... 294/16, 33, 99 R, 8.5; 81/43; 128/321, 354; 24/255 TZ

[56] References Cited

UNITED STATES PATENTS

| | | | |
|---|---|---|---|
| 809,244 | 1/1906 | Bloomquist | 294/99 R |
| 1,767,175 | 6/1930 | Glass | 128/354 |
| 2,860,537 | 11/1958 | Ferguson | 81/43 |
| 3,640,561 | 2/1972 | Law | 294/16 |
| 3,892,435 | 7/1975 | Huey | 294/16 |

*Primary Examiner*—James B. Marbert
*Attorney, Agent, or Firm*—Samuel Lebowitz

[57] ABSTRACT

A tong for picking up litter from urinals, formed by a pair of spaced planar jaws extending in parallel planes from an integral junction at one end towards the opposite end. The free ends of the jaws may be beveled inwardly to provide relatively sharp edges with substantially rectangular corners at the sides of the jaws, to grasp effectively all types of litter when the edges are moved towards each other by manually pressing the jaws together.

2 Claims, 4 Drawing Figures

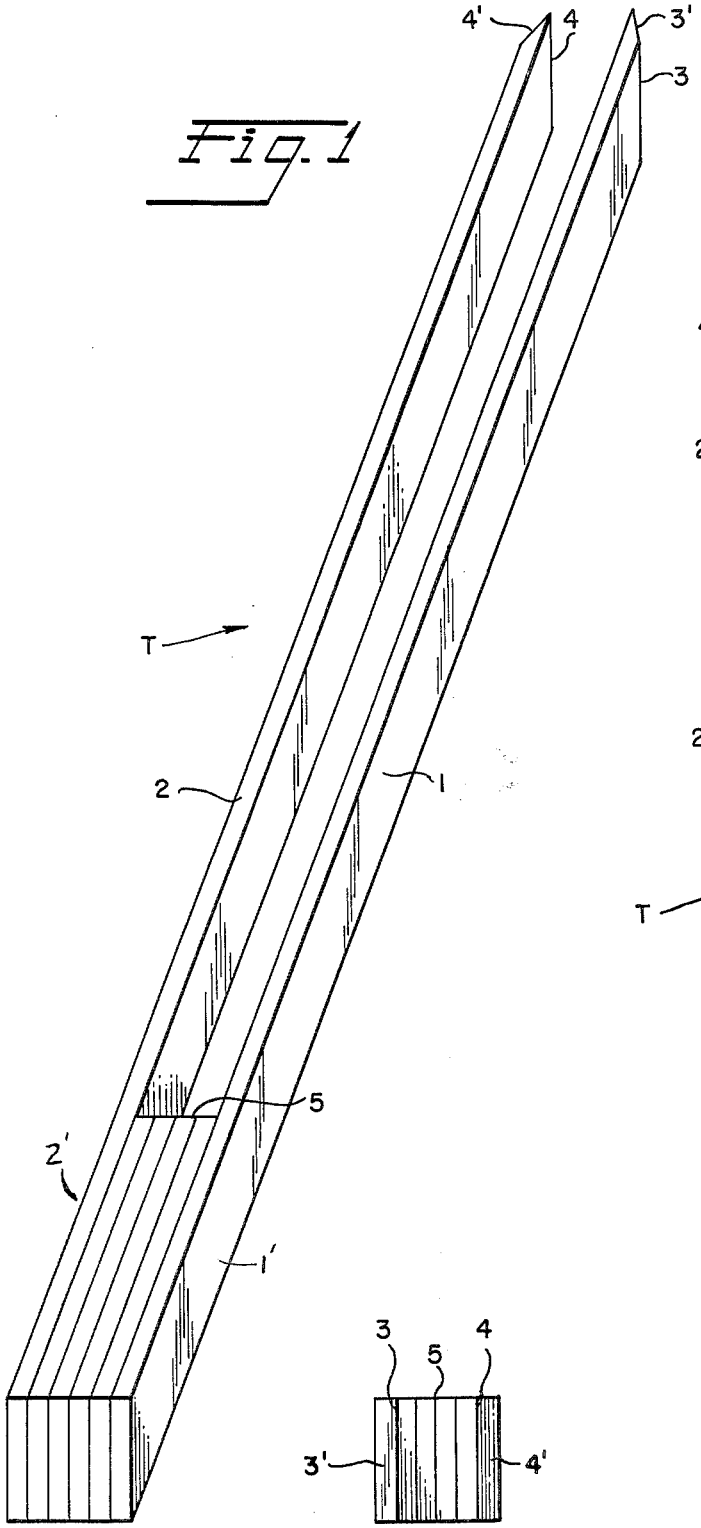
Fig. 1
Fig. 3
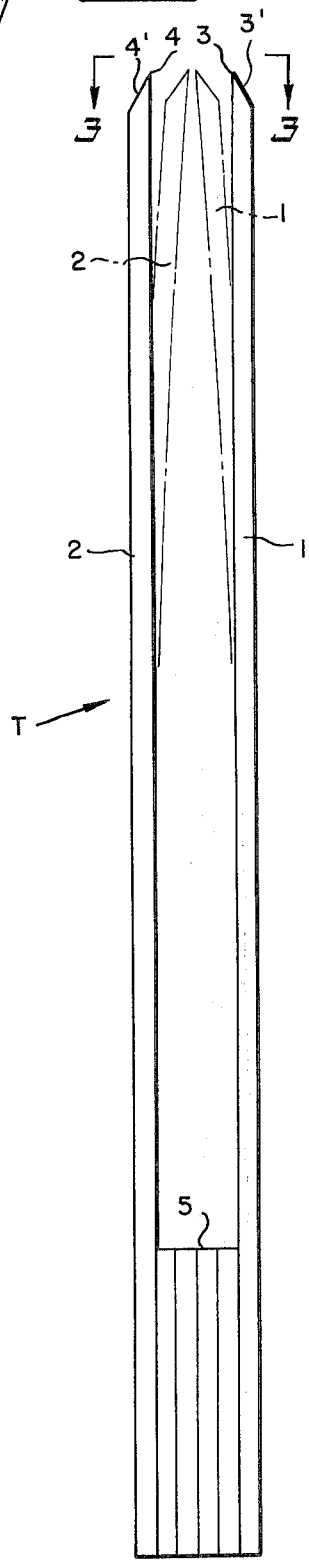
Fig. 2
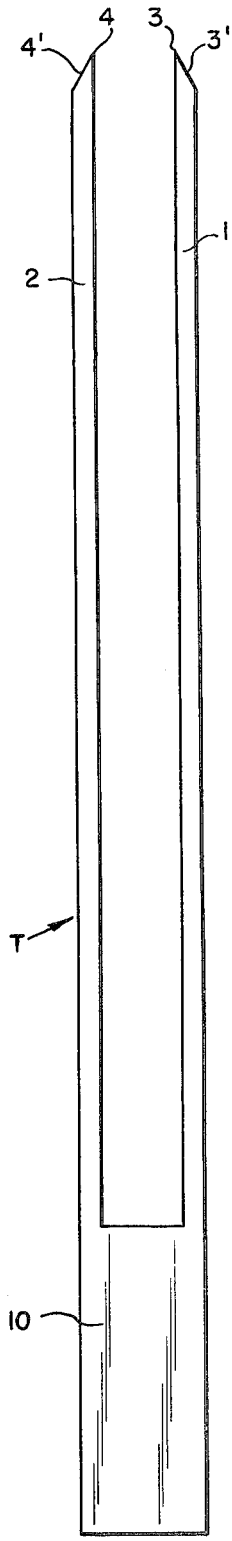
Fig. 4

LITTER TONGS

This invention relates to tongs for picking up litter, and especially litter of all types as often found in urinals.

It is the object of the present invention to provide a pair of tongs of low cost and rugged construction, which is designed to be serviceable over a long period of time, and which makes possible an effective grasping of litter and the positive disposition thereof without any additional handling.

It is the object of the present invention to provide a tong device of integral construction which is formed by a pair of spaced planar jaws extending in parallel planes from the junction end thereof towards the opposite end, whereat the ends are beveled to provide relatively sharp edges, with right angle corners at the sides of the jaws to that the litter may be impaled and grasped securely by the mere pressing of the jaws together at any point along the length thereof, preparatory to the release of the litter therefrom, as soon as the manual pressure is removed. The tongs are of sufficient length to eliminate undue stooping with the resultant discomforts, when used to pick up accumulated litter from urinals.

The tongs of the instant invention are especially designed to perform the functions of picking up litter from urinals and other messy locales, and present a marked improvement over tongs employed for other purposes such as food tongs and clothes tongs of the type disclosed in U.S. Pat. Nos. 809,244, Jan. 2, 1906, and 2,300,894, Nov. 3, 1942.

Other objects and purposes will appear from the detailed description of the invention following hereinafter, taken in conjunction with the accompanying drawings, wherein FIG. 1 is a perspective view of the tongs in accordance with the invention;

FIG. 2 is a plan view of the tongs shown in FIG. 1;

FIG. 3 is an end view of the tongs along line 3—3 of FIG. 2; and

FIG. 4 is a plan view of a modified embodiment of the tongs in accordance with the invention.

In FIG. 1 is shown the tongs T formed essentially by planar jaws 1 and 2 which extend substantially parallel to each other from the ends 1′ and 2′, respectively, whereat they are integrally joined together by an intermediate spacer 5. The opposite ends of the jaws terminate in relatively sharp edges 3 and 4, which edges are formed by beveling inwardly the ends at 3′ and 4′.

The edges are relatively sharp so that all foreign objects in the urinal may be grasped thereby, and the right angles formed between the edges and the sides of the jaws facilitate the impalement and the penetration of the foreign objects in the course of grasping these as the joined edges of the jaws are moved towards each other by pressing them together anywhere along the length of the jaws between the junction end 5 and the free edges 3 and 4, as indicated in dotted lines in FIG. 2. The tongs may be fabricated from any suitable material having sufficient rigidity and yet a degree of flexibility along the length thereof to function in the manner described above.

Thus, the jaws may be formed of strips of wood having dimensions of approximately 3/16 inch in thickness, ¾ inch in width, and at least 15 to 16 inches in length.

As shown in FIGS. 1 to 3, the jaws may be spaced at their joined end by several plys of the same wood employed for the production of the jaws 1 and 2, all of which may be glued together at the joined end 5, which may extend for a length of approximately 3 inches, to impart sufficient strength and rigidity to the fixed end of the tongs. These dimensions make possible a convenient grasp of the tool beyond the junction end and the pressing of the jaws together between the thumb and finger to effect a movement of the free ends of the jaws towards each other to embrace any foreign material therebetween. A relinquishment of the manual pressure on the jaws releases the debris or litter for the proper disposition thereof. The manipulation of the tongs involves a simple hand operation only, and is executed with quickness and dispatch.

If desired, the spacer 5 may be formed of a solid block of wood which may be glued to the inner faces of the jaws. With no pivot joints, the tongs have a long life of service and are maintained in a clean condition easily.

Also, the tool lends itself to formation from molded plastic material, as shown in FIG. 4, wherein the junction end 10 is molded integrally with the jaws 1 and 2 with the remainder of the jaws extending in parallel and capable of flexing, as indicated in FIG. 3.

Of course, the length of the tongs may vary in dependence upon special needs and desires of persons using the device, and these may assume lengths of approximately two feet, or even longer.

I claim:

1. A unitary tong for picking up litter from a urinal by flexing the jaws thereof, comprising a. a pair of jaws of rectangular cross-section integrally joined together at one of the ends thereof by a solid joint and extending in spaced parallelism from said joint to free terminals at the opposite ends of said jaws, b. each of said jaws being of identical construction and of uniform rectangular cross-section up to said free terminals with a width of approximately four times its thickness to permit easy flexing and ready movement of said jaws towards each other by the application of manual pressure applied at any part and beyond the junction thereof, thereby to effect the approach of the free terminals of said jaws into close juxtaposition for grasping securely any litter therebetween, each of said jaws being of a length about sixteen times its width and normally spaced from each other a distance slightly greater than said width, and c. the free terminal of each jaw being of the same width as the remainder thereof but beveled to a sharp edge from the outer to inner face thereof, so that the juxtaposed sharp edges of both jaws, as well as the rectangular corners at the opposite ends thereof, are adapted to reliably grasp all types of litter therebetween.

2. A device as set forth in claim 1, wherein each jaw is approximately 3/16 inch thick, ¾ inch wide, and 12 inches long beyond their common juncture.

* * * * *